United States Patent [19]

Volkers et al.

[11] 3,973,518

[45] Aug. 10, 1976

[54] CROSS MIXING BLENDING CHAMBER FOR ELECTROSTATIC PROCESSORS AND THE LIKE

[75] Inventors: Stewart W. Volkers, Williamson; Robert H. Thon, Walworth, both of N.Y.

[73] Assignee: Xerox Corporation, Stamford, Conn.

[22] Filed: Apr. 28, 1975

[21] Appl. No.: 572,372

[52] U.S. Cl. ..... 118/637; 118/312; 118/612; 259/30; 259/89; 427/242

[51] Int. Cl.[2] ..... G03G 15/08

[58] Field of Search ..... 118/637, 602, 612, 312; 355/3 DD, 15; 427/242; 259/3, 14, 30, 81 R, 89

[56] References Cited

UNITED STATES PATENTS

| | | | |
|---|---|---|---|
| 186,120 | 1/1877 | Davis et al. | 259/30 |
| 3,122,455 | 2/1964 | Grimm et al. | 118/637 |
| 3,381,944 | 5/1968 | Clary | 259/3 |
| 3,724,422 | 4/1973 | Latone et al. | 118/637 |
| 3,846,271 | 11/1974 | Singleton | 259/89 |
| 3,881,446 | 5/1975 | Kurita et al. | 118/637 |

*Primary Examiner*—Mervin Stein
*Assistant Examiner*—Douglas Salser

[57] ABSTRACT

A blender for blending a mixture of flowable materials, such as the carrier and toner components of a developer for an electrostatic processor, comprises a rotatable chamber having radially angulated passageways extending through its periphery for guiding the materials into and out of the chamber and internal axially angulated plates for cross-mixing the materials. The passageways are open, but the mixture tends to at least temporally dwell in the chamber and is, therefore, subject to a tumbling action, because the radial angulation of the passageways exceeds the angle of repose of the mixture. The internal plates impart an axial component to the movement of the tumbling mixture to provide cross-mixing of the materials.

8 Claims, 3 Drawing Figures

CROSS MIXING BLENDING CHAMBER FOR ELECTROSTATIC PROCESSORS AND THE LIKE

BACKGROUND OF THE INVENTION

This invention relates to the blending of flowable materials and, more particularly, to the blending of carrier and toner particles in development systems for continuous electrostatic processors.

In a conventional electrostatic printing process of the type disclosed in Carlson U.S. Pat. No. 2,297,691 on "Electrophotography", a uniformly charged photoreceptor is selectively discharged in an imagewise configuration to provide a latent electrostatic image which is then developed through the application of a finely divided, resinous, electroscopic marking material, called "toner". That process has enjoyed outstanding commercial success, especially in continuous copiers and duplicators (hereinafter collectively referred to as "processors") wherein the toner is applied to the latent image on the fly as the photoconductor moves through a development zone. Nevertheless, substantial effort and expense are still being devoted to the perfection of various aspects of the process, including the development step.

Generally, the toner is transported from a sump to the development zone in triboelectric combination with a relatively coarse, granular "carrier" material, such as glass, sand or ferrite beads. Indeed, that mixture is what is commonly referred to as "developer". During the development process, toner particles are electrostatically stripped from the carrier particles, thereby leaving a residue of partially denuded carrier.

In continuous processors, the partially denuded carrier is returned to the sump for recirculation and fresh toner is manually or automatically added thereto from time-to-time to maintain the toner concentration of the developer at a suitably high level. Ideally, of course, the additional or fresh toner is rapidly blended in with the recirculating developer and brought into appropriate triboelectric relationship with the carrier. Experience has, however, demonstrated that that is difficult to accomplish.

SUMMARY OF THE INVENTION

Accordingly, an important object of this invention is to provide a relatively efficient blender for use in continuous electrostatic processors to rapidly blend fresh toner in with recirculating developer.

Another object of the present invention is to provide a blender which not only does that, but which also effectively increases the developer life.

A further object of the present invention is to provide a relatively efficient, inexpensive and reliable blender having the aforementioned characteristics.

To achieve these and other aims of this invention, the blender disclosed herein comprises a rotatable chamber having radially angulated passageways extending through its periphery and axially angulated, internally mounted cross-mixing plates. The components of a mixture (i.e., the carrier and toner components of a developer for an electrostatic processor) are guided into and out of the chamber in unblended and blended form, respectively, by the passageways. The passageways are open, but the mixture tends to at least temporally dwell in the chamber and is, therefore, subjected to a tumbling action because the radial angulation of the passageways exceeds the angle of repose of the developer. The cross-mixing plates, on the other hand, deflect the tumbling mixture axially of the blending chamber to improve the blending of the mixture.

BRIEF DESCRIPTION OF THE DRAWINGS

Still further objects and advantages of this invention will become apparent when the following detailed description is read in conjunction with attached drawings, in which.

DETAILED DESCRIPTION OF THE ILLUSTRATED EMBODIMENTS

While the invention is described hereinafter in some detail with specific reference to certain illustrated embodiments, it is to be understood that there is no intent to limit it to those embodiments. On the contrary, the aim is to cover all modifications, alternatives and equivalents falling within the spirit and scope of the invention as defined by the appended claims.

Figure 1:
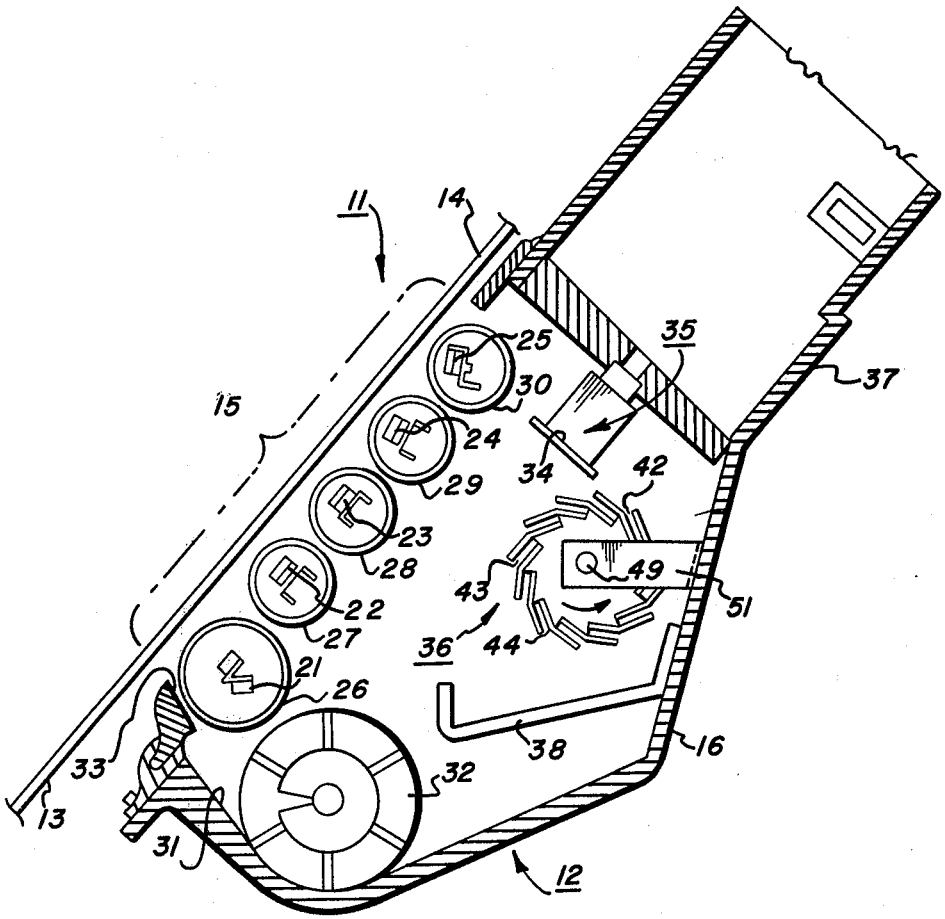
FIG. 1 is a fragmentary elevational view, partially in section, of an electrostatic processor having a development system including a continuous blender constructed in accordance with the present invention.

Turning now to the drawings, and at this point especially to FIG. 1, it will be seen that there is a continuous electrostatic copier 11 (shown only in relevant part) having a magnetic brush development system 12 for developing latent electrostatic images carried by a photosensitive surface 13 of a flexible belt 14 on the fly — viz., as the belt 14 moves through a development zone 15.

To accomplish that, the development system 12 comprises a housing 16 which opens outwardly toward the photosensitive surface 13 to define the development zone 15, together with a plurality of stationary permanent magnets 21-25 which are supported with separate, nonmagnetic, sleeve-like rolls 26-30, respectively. The rolls 26-30 are journalled in the housing 16 for rotation about substantially parallel axes at spaced intervals along the length of the development zone 15, and their surfaces are offset from the photosensitive surface 13 by narrow gaps. Full field development is assured because each of the magnets 21-25 and each of the rolls 26-30 extends across substantially the full width of the development zone 15.

In operation, developer (e.g., toner particles triboelectrically attracted to ferrite carrier particles) travels in a more or less steady stream from a sump 31 in the lower reaches of the housing 16, upwardly through the development zone 15, and then back to a sump 31. To that end, provision (not shown) is made for rotating the rolls 26-30 in a direction (clockwise as viewed) selected to advance the developer through the gaps between those rolls and the photosensitive surface 13. The developer in those gaps columinates under the influence of the composite magnetic field supplied by the magnets 21-25, thereby forming bristle-like stacks of developer which brush against the photosensitive surface 13. If a latent image happens to be present, toner particles are electrostatically stripped from the carrier particles of the columnated developer and transferred to the photosensitive surface 13 to develop the image.

More particularly, as shown there is an elongated paddlewheel 32 which rotates (clockwise as viewed) to transport developer from the sump 31 to pick-up area 33 immediately below the development zone 15. As will be appreciated, the paddlewheel 32 agitates the developer, thereby increasing the triboelectric attraction between the carrier and toner particles. Developer entering the pick-up area 33 is magnetically entrained on the lower roll 26 and then sequentially by the other rolls 27–30 so that it is serially transported through the gaps between the rolls 26–30 and the photosensitive surface 13. At the upper end of the development zone 15, the developer escapes from the magnetic field of the magnets 21–25 as it passes over the top of the upper roll 30. The developer then drops on an inclined slide 34 which guides it through a retoning station 35 and then to a blender 36. From there, the developer drops back to the sump 31.

Typically, of course, there is a more or less conventional toner dispenser 37 mounted above the retoning station 35 so that fresh toner may be added to the recirculating developer from time-to-time, thereby maintaining its toner concentration at a suitably high level. Furthermore, in this instance, there also is a screen 38 positioned between the blender 36 and the sump 31 for removing lumps and other accumulated debris from the developer.

As described and claimed in a concurrently filed and commonly assigned U.S. patent application of S. W. Volkers, Ser. No. 572,371 pending, the blender 36 comprises a rotatable chamber 41 for gently tumbling the developer enroute from the retoning station 35 to the sump 31. The tumbling action not only blends any fresh toner in with the balance of the developer, but also promotes triboelectric charging of the carrier and toner particles. In accordance with this invention, however, it has been found that the blending may be significantly enhanced by imparting an axial component of motion to the tumbling developer. To that end, as shown in FIG. 3, there are a plurality of axialy angulated cross-mixing plates 54–56 mounted internally of the chamber 41.

Concentrating on the blender 36, it will be seen that the chamber 41 is mounted with its axis of rotation generally parallel to the path the developer takes upon leaving the retoning station 35. Moreover, the periphery of the chamber 41 is formed to define a plurality of axially elongated, radially angulated, channel-like passageways 42–44 for guiding the developer into and out of the chamber 41. Importantly, the developer tends to temporally dwell in the chamber 41 because the minimum radial angulation of each of the passageways 42–44 (i.e., the supplement of the largest line of sight angle that the passageway makes with a radius extending from the axis of rotation of the chamber 41 to the inner end of the passageway) is selected to exceed the angle of repose of the developer. The angle of repose of any material is the angle with the horizontal at which the material will stand when piled. As a practical matter that means that each of the passageways 42–44 is radially angulated by at least 25°–40° or so, depending on the composition of and the nominal operating environment for the developer. It should, however, be understood that even greater amounts of radial angulation are tolerable and, in fact, usually desirable inasmuch as the average amount of time the developer dwells in the chamber 41 increases as a direct function of any additional angulation.

Figure 2:
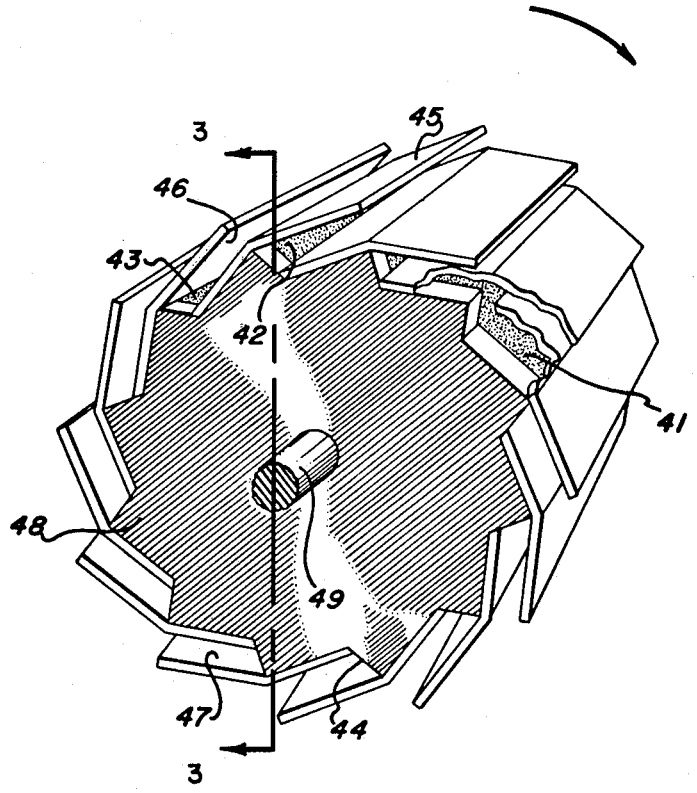
FIG. 2 is an enlarged perspective view of the blender shown in FIG. 1.

As will be apparent, the blender 36 is compatible with a more or less continuous flow of developer from the retoning station 35 to the sump 31. To that end, as best shown in FIG. 2, it comprises a plurality of generally V-shaped ribs 45–47 which are bridged between a pair of end plates 48 (only one can be seen) at regular angular intervals about a drive shaft 49 is pinned or otherwise secured to the end plates 48 and, in operation, is driven to rotate the chamber 41 in a predetermined direction (i.e., counterclockwise as shown). The end plates 48, on the other hand, have matching stepped peripheries for supporting the ribs 45–47 in overlapping relationship. That is, each of the ribs 45–47 has one arm anchored at its opposite ends of the end plates 48 and its other arm freely extending in a contrarotational or clockwise direction into overlying relationship with the anchored or forward-most arm of the next adjacent rib, thereby defining the channel-like passageways 42–44.

Figure 3:
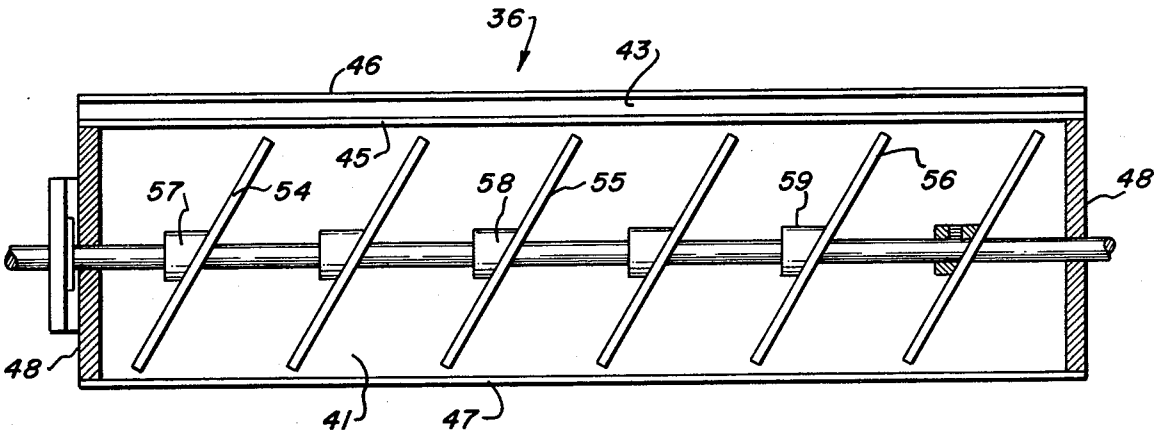
FIG. 3 is a sectional view of the blender taken along the line 2—2 in FIG. 2.

Referring to FIG. 3, in keeping with this invention, to impart an axial component of motion to the developer within the chamber 41, the cross-mixing plates 54–56 are anchored on the drive shaft 49 with an acute angle of inclination relative thereto of, say, 60° or so. As shown, the plates 54–56 have central collars 57–59, respectively, which are typically pinned to the drive shaft 49. Preferably, the plates 54–56 have generally elliptical configurations and are sized to effectively divide the chamber 41 into axially adjacent compartments, thereby permitting the cross-mixing to be carried out on a compartment-by-compartment basis.

SUMMARY

In view of the foregoing, it should now be understood that the present invention provides a relatively simple and reliable, continuous blender for blending mixtures of flowable materials. Moreover, it should be appreciated that the continuous blender of this invention may be used to special advantage in the development system of a continuous electrostatic processor since it not only improves the blending of the carrier and toner components of the developer for the processor but also aids in establishing the proper triboelectric relationship between the carrier and toner components of the developer for the processor but also aids in establishing the proper triboelectric relationship between the carrier and toner particles. Additionally, it will be apparent that when the blender is used in such a processor, the blending chamber provides supplemental storage for developer, thereby increasing the developer capacity of the development system which, in turn, increases the life of the developer.

What is claimed is:

1. In a continuous electrostatic processor having a development system for developing latent electrostatic images on the fly as a photosensitive surface bearing said images moves through a development zone; said system including means for circulating a developer having a predetermined angle of repose and containing triboelectrically charged carrier and toner particles along a predetermined path from a sump, through said development zone, and then back to said sump; the improvement comprising a blender for tumbling and cross-mixing the developer to blend the carrier and toner particles and to promote the triboelectric charging thereof; said blender including a chamber mounted for rotation about an axis generally parallel to and slightly offset from said path, said chamber having a plurality of axially angulated cross-mixing plates mounted therein and a periphery with a plurality of axially elongated, radially angulated passageways extending therethrough; the radial angulation of said passageways exceeding the angle of repose of said developer, whereby developer introduced into said chamber tends to dwell therein to undergo a tumbling action with an axial component of motion being imparted thereto by said cross-mixing plates.

2. The processor of claim 1 wherein said chamber is generally cylinderical and has a substantially constant interior diameter, and said cross-mixing plates are elliptical and sized to substantially match the diameter of said chamber to thereby effectively divide said chamber into a plurality of axially adjacent compartments.

3. The processor of claim 1 wherein said chamber is mounted on a drive shaft, and said cross-mixing plates are secured to said drive shaft at a predetermined acute angle relative thereto.

4. The processor of claim 3 wherein said chamber comprises a plurality of rib-like members bridged between a pair of opposed end plates, said end plates being secured to said drive shaft, and said rib-like members being supported by said end plates in overlapping spaced relationship to define said passageways.

5. The processor of claim 4 wherein said rib-like members are generally V-shaped, with each of said members having one arm anchored on said end plates and another arm freely extending into overlapping spaced relationship with the anchored arm of the next adjacent rib-like member to thereby define said passageways.

6. A blender for blending and cross-mixing a mixture of flowable materials, said mixture having a predetermined angle of repose; said blender including a chamber mounted for rotation about a predetermined axis, said chamber having a plurality of axially angulated cross-mixing plates mounted thereto to provide the cross-mixing and a periphery with a plurality of radially angulated passageways extending therethrough to guide the materials of said mixture into and out of said chamber; the radial angulation of said passageways exceeding the angle of repose of said mixture, whereby the materials of said mixture tend to dwell in said chamber to facilitate the blending and cross-mixing thereof.

7. The blender of claim 6 wherein said chamber is generally cylinderical and has a substantially constant interior diameter, and said cross-mixing plates are elliptical and sized to substantially match the diameter of said chamber to thereby effectively divide said chamber into a plurality of axially adjacent compartments.

8. The blender of claim 1 wherein said chamber is mounted on a drive shaft, and said cross-mixing plates are secured to said drive shaft at a predetermined acute angle relative thereto.

* * * * *